United States Patent [19]

Neff et al.

[11] 4,130,331

[45] Dec. 19, 1978

[54] SOLDERLESS CONNECTOR FOR TERMINATING A MAGNET WIRE OR THE LIKE

[75] Inventors: Nelson E. Neff, Hershey; Anthony F. Thomas, Harrisburg, both of Pa.

[73] Assignee: AMP Incorporated, Harrisburg, Pa.

[21] Appl. No.: 852,004

[22] Filed: Nov. 14, 1977

Related U.S. Application Data

[63] Continuation of Ser. No. 749,185, Dec. 9, 1976, abandoned, which is a continuation of Ser. No. 643,209, Dec. 22, 1975, abandoned, which is a continuation-in-part of Ser. No. 547,318, Feb. 5, 1975, abandoned.

[51] Int. Cl.[2] ..... H01R 9/08

[52] U.S. Cl. ..... 339/97 R

[58] Field of Search ..... 339/95, 97–99

[56] References Cited

U.S. PATENT DOCUMENTS

| | | | |
|---|---|---|---|
| 3,093,433 | 6/1963 | Ege | 339/95 |
| 3,477,059 | 11/1969 | Cole | 339/99 R |
| 3,617,983 | 11/1971 | Patton | 339/98 |
| 3,629,794 | 12/1971 | Kowrimsky | 339/95 D |
| 3,772,571 | 11/1973 | Merry et al. | 339/97 R |
| 3,820,055 | 6/1974 | Huffnagle et al. | 339/97 P |
| 3,854,114 | 12/1974 | Kloth et al. | 339/97 R |
| 3,877,771 | 4/1975 | Jensen et al. | 339/99 R |
| 3,885,853 | 5/1975 | Reimer | 339/97 R |
| 3,955,873 | 5/1976 | Peterson | 339/99 R |
| 3,959,868 | 6/1976 | Mathe | 29/749 |
| 3,977,754 | 8/1976 | Brummans | 339/95 D |

FOREIGN PATENT DOCUMENTS

| | | | |
|---|---|---|---|
| 1640630 | 10/1969 | Fed. Rep. of Germany | 339/97 |

*Primary Examiner*—Joseph H. McGlynn
*Attorney, Agent, or Firm*—Frederick W. Raring

[57] ABSTRACT

A box-like plastic connector housing has one end thereof opened with slots extending down opposite walls from said open end. A raised, anvil-like portion extends from the bottom of said housing upwardly towards said open end with a flat surface on the top thereof positioned between said slots. A magnet wire is inserted in said slots and laid upon said anvil surface. A U-shaped terminal has two thin, flat legs joined together by a transverse element. A slot extends across said transverse element and down into the said two legs. Said U-shaped contact is inserted into said box-like housing with the transverse element being inserted first and with the slots in the terminal legs and the box-like housing being aligned, thereby trapping the wire between the closed ends of said aligned slots, and specifically with the closed end of the slots in said terminal clamping the magnet wire firmly down upon said anvil surface.

2 Claims, 16 Drawing Figures

SECTION A-A
OF FIG. 1

SECTION B-B
OF FIG. 1

SECTION A-A
OF FIG. 1

SECTION B-B
OF FIG. 1

SOLDERLESS CONNECTOR FOR TERMINATING A MAGNET WIRE OR THE LIKE

CROSS-REFERENCE TO RELATED APPLICATION

This application is a continuation of application Ser. No. 749,185, filed Dec. 9, 1976 and now abandoned, which was a continuation of application Ser. No. 643,209, filed Dec. 22, 1975 and now abandoned, which was a continuation-in-part of application Ser. No. 547,318, filed Feb. 5, 1975 and now abandoned.

BACKGROUND OF THE INVENTION

This invention relates generally to a connector means for the connection of a first wire to a second wire, and more particularly to a connector means which, by the single operation of inserting the terminal portion of the connector means into its housing, will strip one of said wires of its insulation, and secure said wire mechanically and electrically to said terminal portion, without solder.

There are many applications where it is desired to physically secure a wire in preparation for making an electrical connection to another wire. Such a need for securement is characteristic of magnet wires, particularly magnet wires of the type used in televsion yokes, motor field windings, transformers and the like. In these type applications the fine magnet wire is usually wound upon a bobbin or core with the end of the wire to be electrically connected to some external wire, usually known as a lead wire and extending to a brush in the case of an electric motor field winding, or to other external circuits in the case of other type coils.

The need for securing the end of the coil winding in preparation for making electrical connection is to prevent the last few turns of the coil from becoming unwound. In the prior art such securing is done by a human operator who manually assures the end of the winding to some appropriate holding device until a soldering operation to a terminal or external conductor can be effected.

More recently, in U.S. Pat. No. 3,725,707, issued Apr. 3, 1973, to Leinbach et al and entitled "Field Assembly For Universal Electric Motors", there is disclosed a means whereby a connector housing is secured on the ends of the laminations forming the field core, with terminals mounted therein. These terminals are constructed to receive the ends of the coil windings to secure such coil winding ends mechanically and also to make electrical connection therewith. More specifically, each of the terminals have one end thereof formed into a cylindrical portion with an inwardly extending lance. The coil or magnet wire is inserted into said cylindrical portion of the terminal and retained therein by the inwardly extending lance, which not only functions to retain the wire but also scrapes the insulation therefrom to make electrical contact therewith.

The arrangement of the afore-mentioned U.S. Pat. No. 3,725,707 involves the separate steps of mounting the connector housing upon the rotor or stator laminate, followed by the mounting of the terminal therein and subsequently followed by the insertion of the magnet wire into the cylindrical portion of said terminal.

BRIEF STATEMENT OF THE INVENTION

It is a primary object of the invention to provide a connector mounted upon a support which is common to the coil and to which the end of the coil wire can be easily connected electrically and mechanically, without the aid of solder and by automated means, without permitting any unwinding of the coil while such connection is being made.

It is a second aim of the invention to provide a connector for terminating the ends of a magnet wire mechanically and electrically, without the necessity of removing the wire insulation separately and without the use of solder, and adaptable to automation of such termination.

It is a third purpose of the invention to provide a connector to which more than one magnet wire simultaneously can be connected in a simple manner, electrically and mechanically and without the use of solder, and further with the insulation on said magnet wire being automatically removed during the process of such connection.

It is a fourth object of the invention to provide a connecting means to which one or more magnet wires can be connected simultaneously, both electrically and mechanically by automated means, and without the effect of the last few turns of said coil becoming loosened during said connection.

A fifth purpose of the invention is the connection of one wire to another, both mechanically and electrically without the use of solder in either connection, and adaptable to automated operation.

A sixth object of the invention is the improvement generally of connectors for connecting one wire, as for example, a magnet wire, to a second wire.

In accordance with one form of the invention there is provided at least one box-like housing member of insulative material opened at one end and having a pair of slots extending down the walls thereof from said open end. A raised portion, sometimes referred to herein as an anvil, extends upwardly from the bottom of said box-like member and towards the open end thereof, terminating in a flat surface substantially parallel with the open end of the box-like housing and located in-between the two slots formed in the walls thereof. A wire, such as a magnet wire, is inserted into the two slots with that portion of the wire between the two slots resting upon said surface of said anvil. The width of at least one of said two slots can be slightly less than the diameter of the wire so as to secure said wire within said slot.

The terminal portion of the connector comprises a U-shaped portion with first and second relatively thin, flat legs joined together by a transverse section. A slot is formed across said transverse section between said two legs and extends downwardly into said two legs. The location of the slots in said two legs of the terminal is such that they are aligned with the slots in the box-like element when said contact terminal is inserted therein, with the transverse section being inserted first. The portion of the slot extending across the transverse section is sufficiently wide so that the anvil portion of the box-like element will pass through the slot in said transverse element and enter the space between the two legs of the U-shaped terminal.

In accordance with one feature of the invention, the dimensions of the box-like element, the depth of the slots in the two legs of said terminal, and the heighth of the flat surface of the anvil bear such a relation to each other that the closed end of the slots in the two legs of said terminal will force the wire laid within the slots in the box-like element and across the surface of said anvil down upon the said anvil surface slightly down below the edge of said anvil surface, thereby making good electrical and mechanical connection between said wire and said electrical metal terminal.

Furthermore, the width of at least one of the slots in said two legs of said metal terminal can be narrower than the diameter of said magnet wire, thereby scraping or scrubbing away the insulation on said magnet wire to further ensure good electrical and mechanical connection between said wire and said terminal.

In accordance with another feature of the invention a pair of outwardly extending lances or sharp edged protuberances are formed to extend outwardly from each of the two sides of each of the two legs forming the U-shaped terminal. The sharp edges of these lances scrape against the inner surfaces of the box-like housing as the terminal is inserted therein, and thereby performing two functions. The first of these functions is to mechanically retain the terminal within the box-like housing. The second function is to transmit a spring-like force from the sides of the housing wall to the bifurcated portions of the legs (formed by the slots therein), thereby forcing said bifurcated portions of said legs towards each other and against the magnet wire entrapped therein. More specifically, one of the two lances on each edge of a leg can be positioned near the transverse portion of the U-shaped element to form a fulcrum for the bifurcated portions of the terminal legs, and the other lance can be positioned near the transverse portion of the terminal, thereby forcing the free end of the bifurcated portions of the leg, which are in the nature of cantilever beams, towards each other and upon the wire entrapped therein. By forcing the ends of the bifurcated portions of said legs towards each other, more than one magnet wire can be inserted in the slot between said bifurcated portions, with good electrical and mechanical connection being made between each of said wires and the sides of said slot.

In accordance with still another feature of the invention each of the terminals has a second portion thereof to which a second conductor can be secured. The second portion of said terminal can be of several different configurations, some of which require soldering, and some of which do not require soldering, and most of which can be made by automated equipment.

More specifically, as examples, the second portion of said terminals can be of a barrelled configuration constructed to be crimped around a conductor laid therein, a post configuration around which a conductor can be wrapped, a spade or tongue configuration, or one of several other well known types of termination.

BRIEF DESCRIPTION OF THE DRAWINGS

The above-mentioned objects and other features of the invention will be more fully understood from the following detailed description thereof when read in conjunction with the drawings in which.

DETAILED DESCRIPTION OF THE INVENTION

Figure 1:
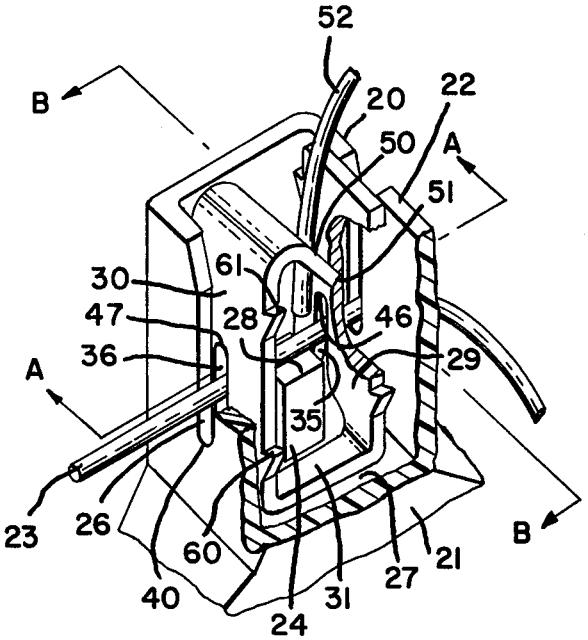
FIG. 1 is a perspective view of the invention with a portion of the contact housing and also a portion of the contact broken away to disclose the relationship between the slots in the housing and the slots in the terminal.

Referring now to FIG. 1 there is shown a perspective, broken-away view of one form of the invention. More specifically, a box-like plastic housing 20 is formed on or secured to some appropriate base 21, which base can be the housing or supporting structure of a transformer coil, a field stator coil, or a television yoke, for example.

The box-like element 20 has a pair of slots, such as slot 26, extending down the walls from the open end thereof. In FIG. 1, only the slot 26 can be seen. The corresponding slot on the opposite wall of the box 20 is hidden by the contact 22 which is shown positioned within the box-like element 20.

A raised portion 24, which can be described generally as an anvil, is formed integrally with the box-like element 20 and extends upwardly from the bottom surface 27 thereof. The portion 23 of the magnet wire is laid into the housing slots, such as slot 26 and upon the top surface 28 of anvil 24.

The terminal 22 is generally U-shaped in configuration, having two thin, flat main legs 29 and 30 joined together at the bottom by a transverse portion 31.

Figure 2:
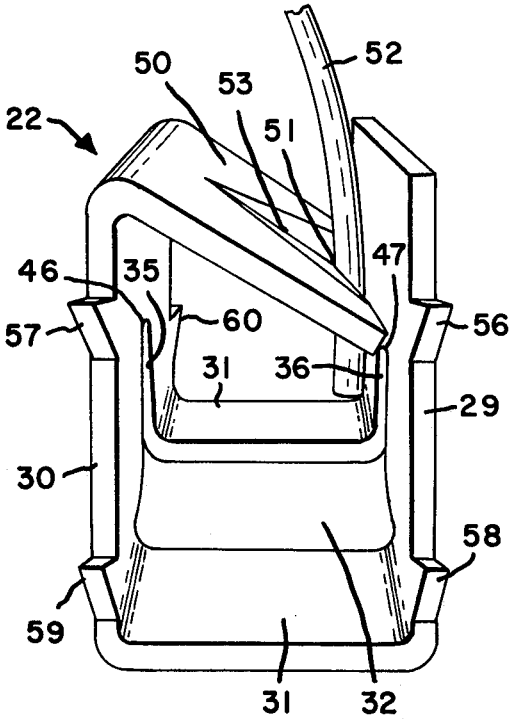
FIG. 2 is a single vanishing point perspective view of the terminal employed in the structure of FIG. 1.

As can be seen from the single vanishing point perspective view of the contact shown in FIG. 2, the transverse portion 31 has a slot 32 formed therein to divide said transverse portion 31 into two legs. The said slot 32 extends downwardly into the two legs 30 and 29. The extended slots 35 and 36 formed in legs 29 and 30 are positioned in the legs 29 and 30 in such a manner as to be aligned with the slots in the walls of the box-like housing 20, such as slot 26, for example.

Furthermore, from FIGS. 1 and 2, it can be seen that the slots 35 and 36 in the terminal 22 and the slots, such as slot 26, in the box-like housing 26, have opposing closed ends so that as the terminal 22 is inserted in the box 20, the closed ends of the slots of the terminal 22 and the box-like element 20 approach each other. However, before the closed ends 46 and 47 of the slots 35 and 36 in the terminal 22 reach the closed ends of the slots 26 in the housing 20, the closed ends of slots 35 and 36 will bear against the magnet wire 23, which has been placed across the anvil 31, and will thereby firmly engage said magnet wire 23 both mechanically and electrically.

Figure 3:
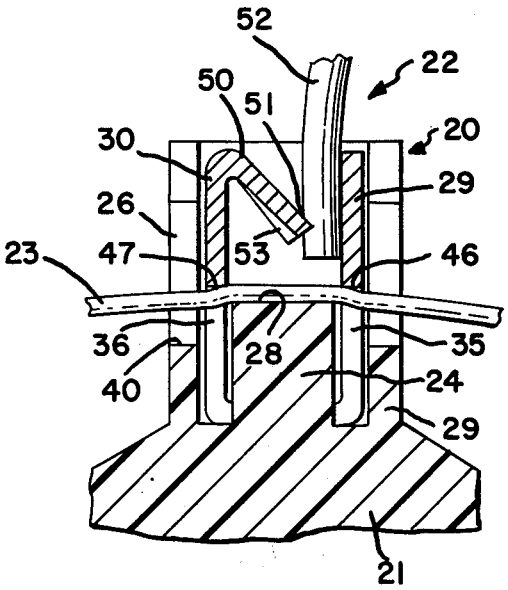
FIG. 3 is a sectional view of the structure of FIG. 1 taken along the plane A—A thereof.

Reference is made to FIG. 3 which shows a sectional view taken along the plane A—A of FIG. 1, and more clearly shows the relationship between the slots 36 and 35 in terminal 22, the surface 28 of anvil 24 and the action thereof upon the magnet wire 23. More specifically, it can be seen that the closed ends 46 and 47 of the two slots 35 and 36 extend down into the box-like element 20 a sufficient distance to clamp the magnet wire 23 firmly against the surface 28 of anvil 24 and, in fact, will bend the magnet wire 23 slightly downwardly at the corners of the anvil 24, as shown in FIG. 3.

Referring again to FIG. 1 the free end of the leg 30 is bent over to form an extension portion 50 which extends downwardly and inwardly into the interior of the U-shaped contact 22 and towards the other leg portion 29 thereof. An external wire 52 can be inserted or poked down into the gap between the terminating edge 51 of the bent over portion 50 and the interior surface of the other leg 29 of the terminal 22 to make electrical contact therewith and further to be mechanically held therein.

The relation between the inserted conductor 52 and the contact 22 can be more clearly seen from the views of the contact shown in FIGS. 2 and 3. In FIG. 2 for example, it can be seen that the bent-over portion 50 has a V-shaped, depressed portion 53 formed therein which functions to maintain the position of the conductor 52 in the center of the terminating edge 51 of said bent over portion 50. It can also be seen in FIG. 2 that terminating edge 51 will bite into the conductor 52 inserted therein due to the angle of the bent over portion 50 with respect to the inner surface of the other leg 29. Further, because of such angular relationship between the bent over portion 50 and the inner surface of the other leg 29, any attempt to withdraw the conductor 52 would only result in the terminating edge 51 of the bent over portion 50 biting harder into conductor 52 and increasing both the electrical contact and the mechanical securing of said conductor 52 in the terminal 22.

A sectional view of the relationship between the poked in conductor 52 and the terminating edge 51 of the bent over portion 50 and the interior surface of the other leg 30 can be seen in FIG. 3.

Figure 4:
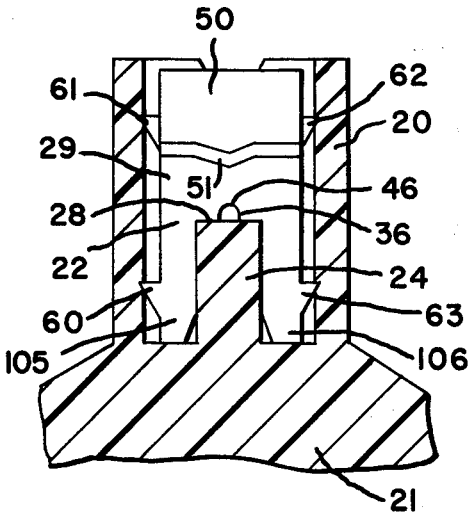
FIG. 4 is a sectional view of the structure of FIG. 1 taken along the plane B—B thereof.

Reference is made to FIG. 4 which shows in detail the means by which the contact 22 is maintained within its housing 20. More specifically, in FIG. 4 there is shown four tangs or lances 60, 61, 62 and 63 which bite into the inner surfaces of the walls of the box-like housing 20. It will be noted that the positions of the four tang elements 60 through 63 is important. More specifically, the lances 61 and 62 are located near the top of housing 20 and near the top of the slot 36 formed in the leg 30 of contact 22. The other pair of lances 60 and 63 are located near the bottom of the slot 36 so that each of the two bifurcated portions 105 and 106 of the leg 30 separated by the slot 46 form an element in the nature of a cantilever beam, the ends of which are forced together by the force transmitted from the walls of the box 20 through the lances 60 and 63. Because of the forcing together of these cantilever beams 105 and 106, the slot 46 is capable of retaining more than one magnet wire, as shown in FIG. 5.

Figure 5:
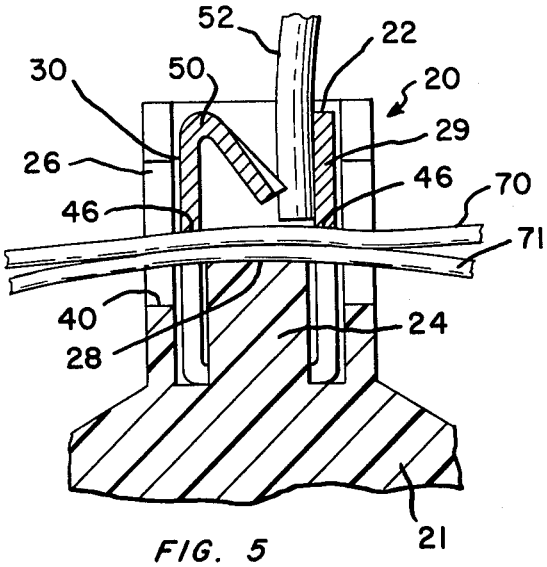
FIG. 5 is a sectional view of the structure of FIG. 1 taken along the plane A—A but with two magnet wires retained in the connector rather than one magnet wire.

In FIG. 5 the various elements thereof which have corresponding elements in FIG. 3 are identified by the same reference characters. The principal difference between FIGS. 3 and 5 is that in FIG. 5 two magnet wires 70 and 71 are shown as being entrapped in the slots within the housing 20 and the terminal 22, rather than one magnet wire.

Figure 6:
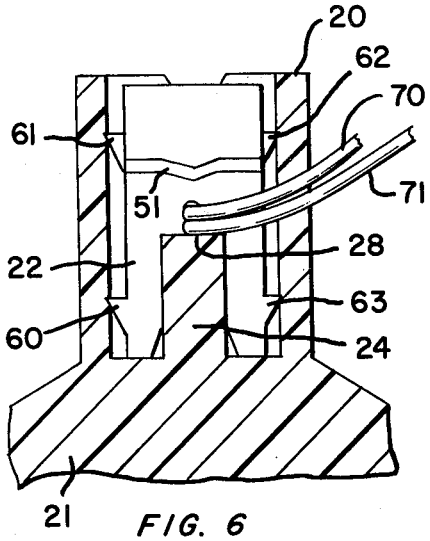
FIG. 6 is a sectional view taken along the plane B—B of FIG. 1 but again with two magnet wires being retained therein rather than one magnet wire as shown in FIG. 1.

Similarly, FIG. 6 shows structure similar to that of FIG. 4 except that two magnet wires 70 and 71 are entrapped in the slots in the housing and the terminal rather than one. All the remaining portions of the structure of FIG. 6 are identified by the same reference characters as the corresponding parts of FIG. 4.

Figure 7:
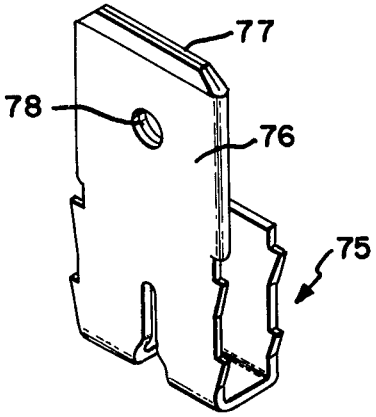
FIG. 7 is another form of terminal employable in the invention wherein that portion of the terminal protruding out of the connector housing and into which an external connector is to be connected is a spade-type configuration with a hole therethrough and through which an external conductor can be inserted and soldered.

Referring now to FIG. 7 there is shown a form of the terminal in which the portion 75 which fits within the box-like receptable, such as housing 20 of FIG. 6, does not contain the bent over portion 50, as shown in FIG. 1, and which is employed to hold the external conductor. In lieu thereof there is provided a space-like portion 76 which extends out of the box-like housing with a hole 78 formed therein and which is terminated in a beveled tip 77. The external conductor can be inserted through the hole 78 and soldered thereto.

Figure 8:
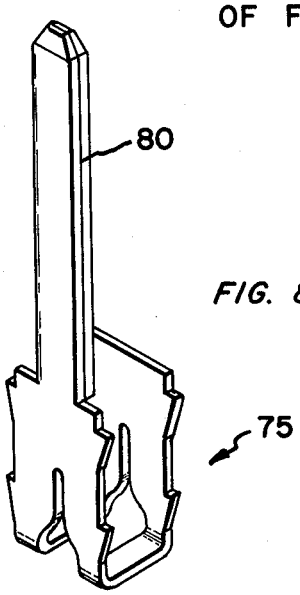
FIG. 8 is another form of a terminal employable in the invention wherein the portion of the terminal extending out of the housing is a post.

Referring now to FIG. 8 there is shown yet another form of the terminal, which, as in the case of the structure of FIG. 7, does not have a bent over portion 50, as shown in FIG. 1. In lieu thereof there is provided a post 80 to which an external conductor can be attached either by wire wrapping or other known techniques.

Figure 9:
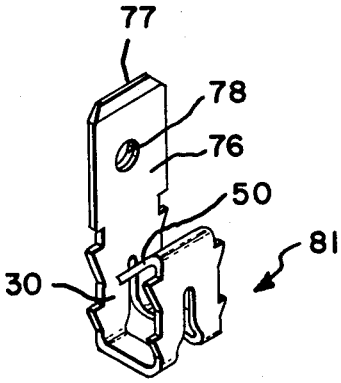
FIG. 9 is still another form of a terminal useable in the invention in which the portion protruding out of the housing is a spade-like element with a hole therein through which an external conductor can be secured, and which also has a bent-over portion on one of the legs within the housing to which a second external conductor can be connected.

Referring to FIG. 9 there is shown yet another form of the terminal quite similar to the structure of FIG. 7 except that FIG. 9 shows a bent over portion 50 which extends towards the inner surface of the opposite leg 30, shown in FIG. 1.

Figure 10:
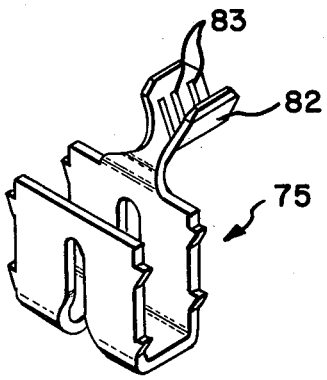
FIG. 10 is yet another form of a terminal which can be utilized in the invention and wherein the portion of the terminal extending out of the housing is an open barrel to which an external conductor can be retained by crimping.

Referring now to FIG. 10 there is shown yet another form of the invention wherein the base portion 75 is similar to the U-shaped base portion of FIG. 7 which fits within the box-like housing 20 of FIG. 1. The portion of the terminal extending out of the housing 20 is an open barrel configuration 82 with serrations 83 formed therein. The external conductor is laid within the barrel 82 and is then crimped over the external conductor.

Such crimped connection can either be soldered or not, as desired.

Figure 11:
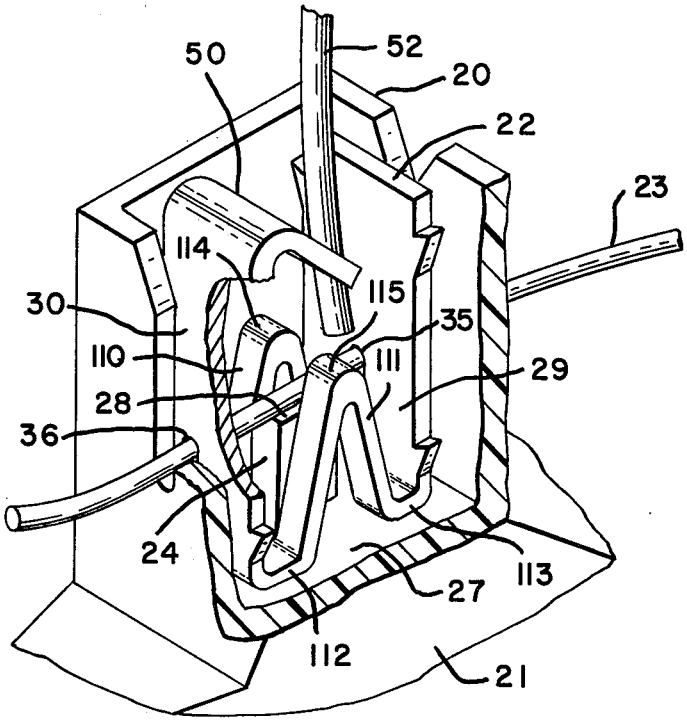
FIG. 11 shows a broken away perspective view of another form of the invention.

Referring now to FIG. 11 there is shown still another form of the invention. The principle difference between the structure of FIG. 11 and the structure shown in FIG. 1 lies in the transverse section of the U-shaped portion of terminal 22. More specifically, in the structure of FIG. 11 the transverse section is comprised of two inverted V-shaped elements 110 and 111 which have their apexes 114 and 115 extend above the surface 28 of the wire supporting anvil 24. The portions 112 and 113 of the transverse section of terminal 22 rest on the bottom surface 27 of the box-like housing 20.

Because the apexes 114 and 115 of the V-shaped transverse sectional elements 110 and 111 extend above the surface 28 of wire supporting means 24, the supported wire 23 is prevented from sliding off either side of said surface 28, thereby further ensuring good electrical and mechanical connection between the edges of slots 36 and 35 in the two legs 30 and 29 of terminal 22.

Those portions of the structure of FIG. 11 which correspond to the elements of the structure of FIG. 1 are identified by the same reference characters.

Figure 12:
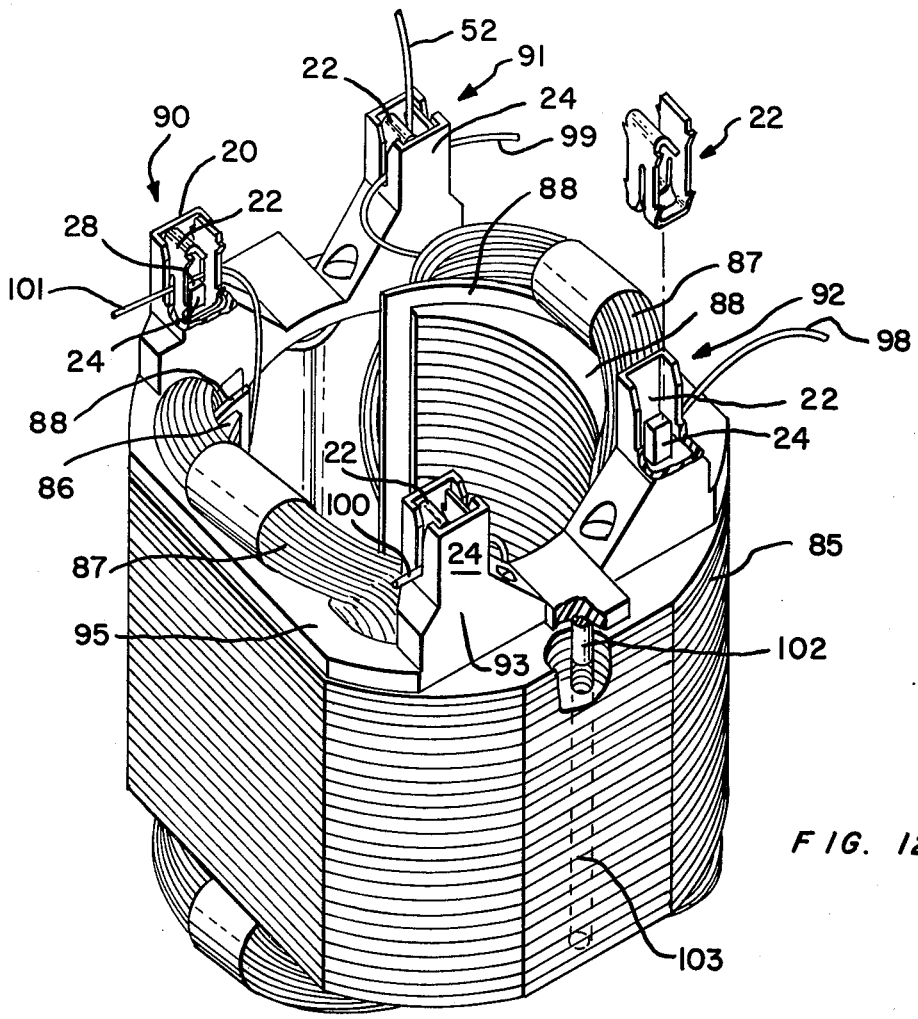
FIG. 12 is a perspective view of one application of the subject of the present invention to a motor stator assembly which is the subject of a separate and copending application, filed on the same date as the parent application hereto.

Referring now to FIG. 12 there is shown an application of the present invention in a motor stator assembly. The assembly includes a stack of annular laminations 85 having two pole pieces 86 formed thereon and around which two coils 87 are wound. The coils 87 are separated from the laminations by sheets of insulative material 87. Four of the connectors of the type shown in FIG. 1, and identified by reference characters 90, 91, 92 and 93, are shown integrally mounted upon an annular plastic housing base 95.

Each of the four connectors 90 through 93 are shown in different forms to illustrate the details thereof. More specifically, the connector 92 is shown with the terminal element 22 removed therefrom. It will be noted that terminal 22 is identical to the terminal 22 shown in FIG. 2 and that the housing 20 into which terminal 22 fits is the same as the housing 20 of FIG. 1. The lead wire 98 is shown as not being yet inserted across the anvil 24 of housing 20.

The connector 91 shows the complete assembly of the terminal 22 in its housing 24 and with a magnet wire 99 and external conductor 52 connected therein.

The connector 93 shows the terminal 22 inserted in the housing 24 with a magnet wire 100 inserted therein but with no external conductor connected thereto.

The conductor 90 shows a portion of the housing broken away and illustrates in detail the magnet wire 101 positioned across the surface 28 of anvil 24 within the housing 20. The terminal 22 is shown as being inserted. A pin 102 which can be formed as an integral part of the annular plastic base 95 fits into a hole 103 which is formed in the annular laminated sections 85 to thereby hold the annular base 95 onto the field core formed by the laminations 85.

Figure 13:
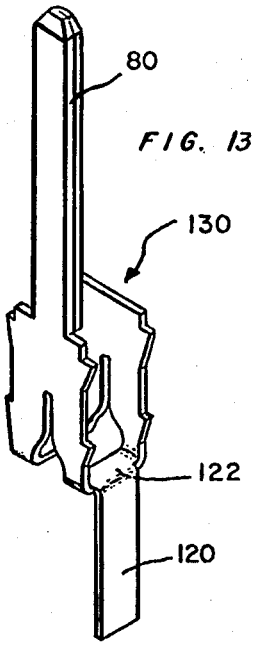
FIG. 13 is a perspective view of another form of the terminal having a third leg extending off the transverse portion thereof.

Referring now to FIG. 13 there is shown a terminal 130 which is similar to that shown in FIG. 8 with the exception that the terminal of FIG. 13 has an additional post 120 extending from the side of the transverse section 122 of the terminal. The additional post 120 could also be employed with the terminals shown in FIGS. 2, 7, 9, 10 and 11.

Figure 14:
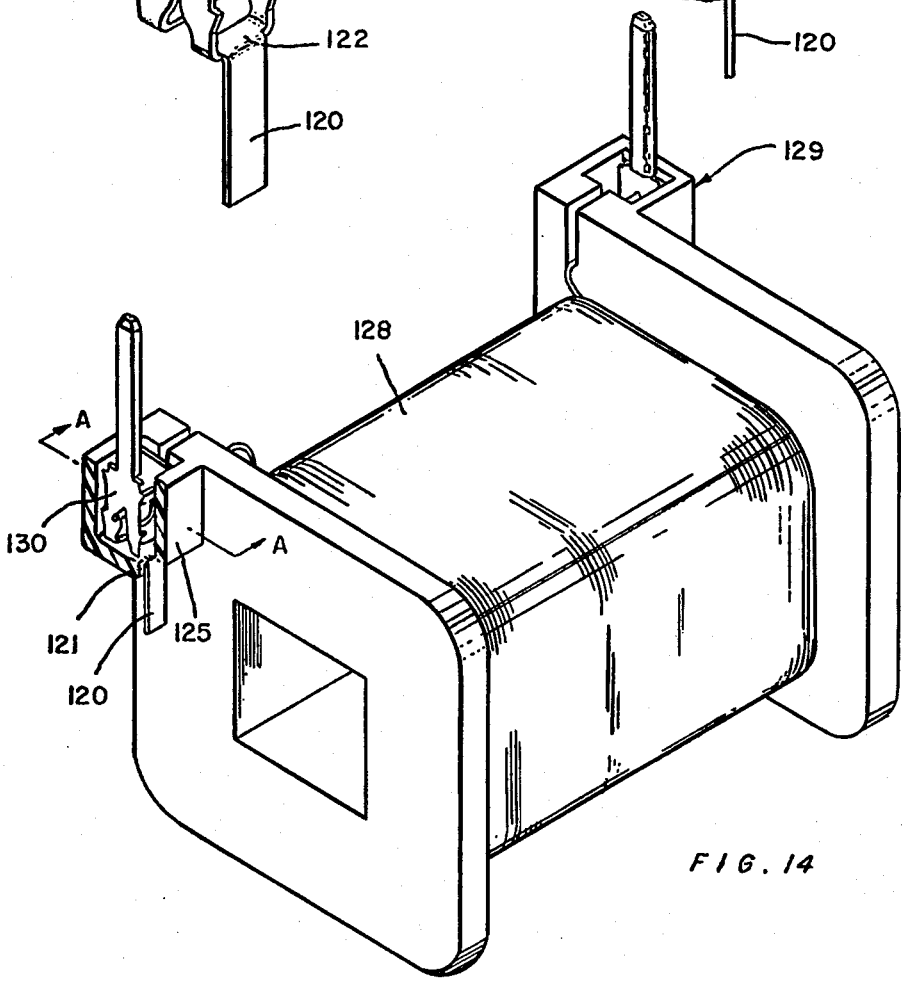
FIG. 14 is a perspective view of a coil bobbin containing a pair of connector housings mounted thereon for retaining the terminal of FIG. 13 and having apertures therein for the extension of the third legs of the terminal of FIG. 13 therethrough.

In FIG. 14 the terminal of FIG. 13 is shown installed in a housing cavity 125 which has a slot 121 formed therein to permit the post 120 to extend therethrough. While the extension of the post 120 through the bottom of the cavity 125 precludes the cavity 125 from being mounted in the manner in which cavity 24 is mounted in FIG. 12, for example, the cavity 125 of FIG. 14 can be advantageously side mounted to a suitable supporting means such as the side of coil bobbin 128. A similar terminal and housing 129 is shown mounted on another side of bobbin 128. Such a manner of mounting the connector 130 permits free extension of the post 120 through the aperture 121 in the housing 125 and subsequent electrical connection to said post 120.

Figure 15:
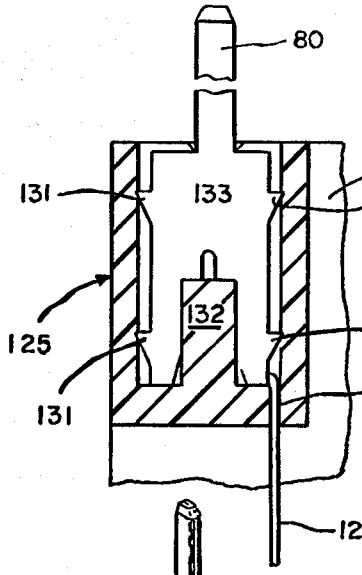
FIG. 15 is a sectional view of one of the contact retaining cavities of FIG. 14 taken along the plane A—A.

A sectional view of the connector including housing 125 and terminal 130 taken along the plane A—A of FIG. 14 is shown in FIG. 15. The extension of the post 120 through the aperture 121 in housing 125 can be clearly seen. Also, the retention of the terminal 130 within the housing 125 by means of tangs 131 is apparent from FIG. 15. A raised portion or anvil 132 is provided to support a wire inserted in the slot 133 of the terminal 130 in the manner and for the purpose discussed in connection with the structures of FIGS. 5 and 6.

Figure 16:
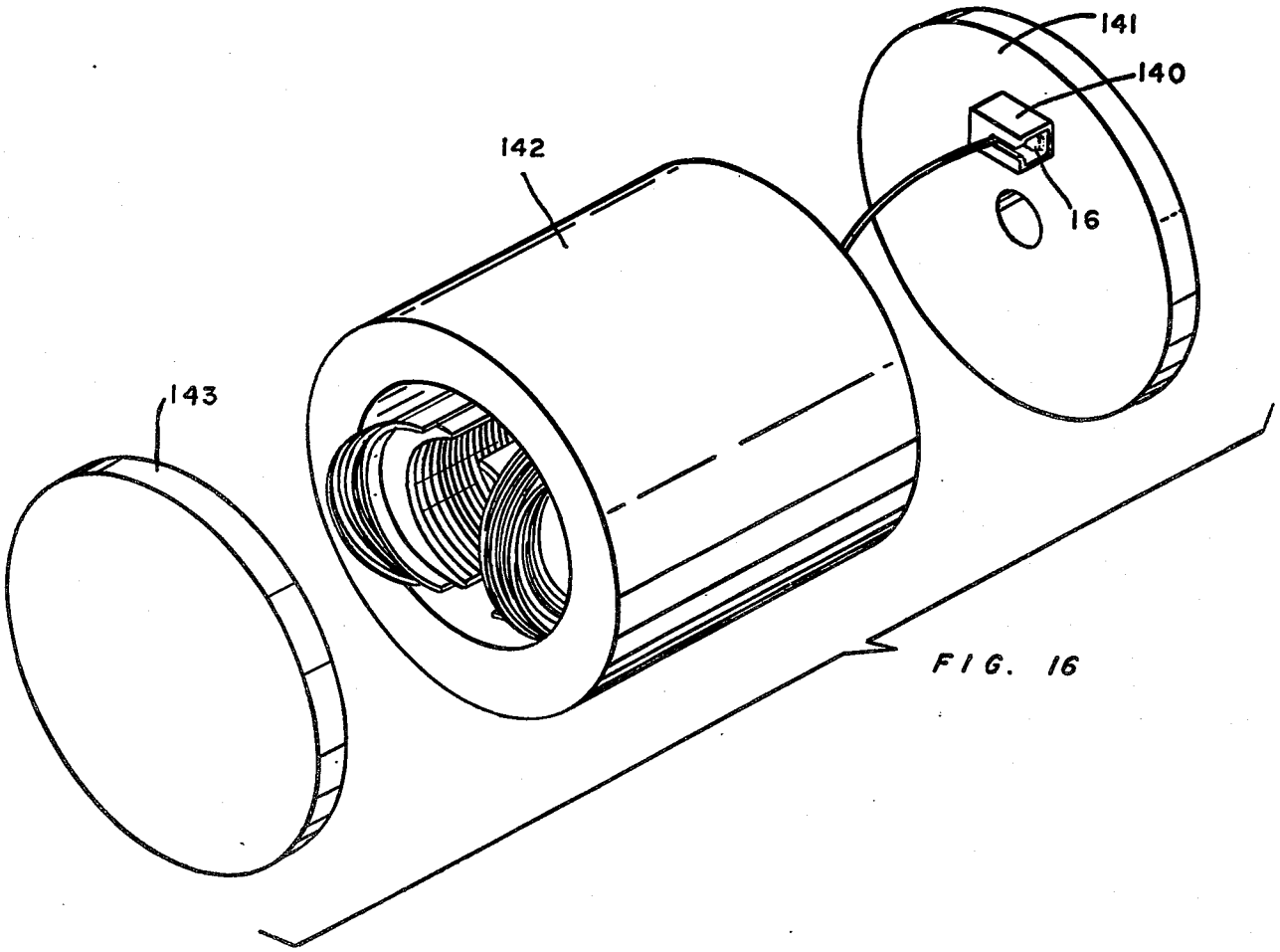
FIG. 16 is a perspective view of an adaptation of the connector of the present invention when made entirely of a conductive metal and used for electrical grounding purposes.

Referring now to FIG. 16 there is shown a connector 140 which is similar in shape to the connector shown in FIG. 1, for example, but which is made entirely of metal, including the housing. The purpose of the all metal connector 140 is for grounding purposes. In the typical application shown the connector 140 is connected to the metal end cap 141 of a motor consisting of stator 142, first end cap 143 and second end cap 141. Wires to be grounded are secured within the connector 140 in the same manner as discussed in connection with FIGS. 1 and 5, for example.

It is to be understood that the forms of the invention shown and described herein are but preferred embodiments thereof and that various changes of design can be made therein, including different configurations of the portion of the terminal extending from the box-like housing, without departing from the spirit or scope thereof.

We claim:

1. In combination, a wire and a connector for terminating said wire, said connector comprising:

housing means constructed to form a contact retaining structure having front and back side walls, a bottom surface, and open at the end opposite said bottom surface;

said housing means having first and second slots formed in said front and back side walls, each with an open end and a closed end and with said open end extending down said front and back side walls from said open side thereof;

said housing means further comprising an anvil-like wire supporting means extending upwardly from said bottom surface to about the level of the closed ends of said first and second slots and positioned between said front and back side walls;

said wire being inserted in said first and second slots and laying across said wire supporting means;

terminal means comprising a U-shaped conductive member having first and second plate-like legs with first ends thereof connected together by a connecting transverse section and having third slot means extending across the center of said connecting transverse portion to divide said transverse portion into two sections and further extending down into said first and second legs thereof as fourth and fifth slots;

said terminal being inserted in said contact retaining structure with the two sections of said transverse portion facing the bottom surface of said housing means and straddling said anvil-like wire supporting means, and with said fourth and fifth slots in said first and second legs thereof being aligned in an inverted position with respect to said first and second slots to trap the inserted wire end between the closed ends of said first and second slots and said fourth and fifth slots; and at least one of said first and second slots and at least one of said fourth and fifth slots having a width slightly narrower than the diameter of said wire.

2. In combination, a first conductor having a conductive wire portion and a connector for terminating said conductor, said connector comprising:

housing means constructed to form a contact retaining structure having front and back sidewalls, a bottom surface having an aperture therein, and open at the end opposite said bottom surface;

said housing means having a first and second slots formed in said front and back sidewalls, each with an open end and a closed end and with said open end extending down said front and back sidewalls from said open side thereof;

said housing means further comprising an anvil-like conductor supporting means extending upwardly from said bottom surface to about the level of the closed ends of said first and second slots and positioned between said front and back sidewalls;

said conductor being inserted in said first and second slots and laying across said conductor supporting means;

terminal means comprising a U-shaped conductive member having first and second plate-like legs with first ends thereof connected together by a connecting transverse section and having third slot means extending across the center of said connecting transverse portion to divide said transverse portion into two sections and further extending down into said first and second legs thereof as fourth and fifth slots;

said terminal being inserted in said contact retaining structure with the two sections of said transverse portion facing the bottom surface of said housing means and straddling said anvil-like conductor supporting means, and with said fourth and fifth slots in said first and second legs thereof being aligned in an inverted position with respect to said first and second slots to trap the inserted conductor between the closed ends of said first and second slots and said fourth and fifth slots;

said terminal having a third leg extending from said transverse section and through said aperture in said bottom surface of said housing means, at least one of said fourth and fifth slots have a width slightly narrower than the diameter of said wire portion;

said terminal means further comprising engaging means to physically engage said housing means to be retained therein.

* * * * *